United States Patent [19]

Stangle

[11] 4,403,772

[45] Sep. 13, 1983

[54] UNITARY SELF-CONTAINED PHYSICAL CONDITIONING STRUCTURE

[76] Inventor: Lynn B. Stangle, Box 25, St. Francisville, Ill. 62460

[21] Appl. No.: 302,316

[22] Filed: Sep. 14, 1981

Related U.S. Application Data

[63] Continuation of Ser. No. 96,051, Nov. 20, 1979, abandoned.

[51] Int. Cl.[3] ..... A63B 69/00

[52] U.S. Cl. ..... 272/78; 272/117; 272/76

[58] Field of Search ..... 272/78, 61, 109, 115 A, 272/117, 76, 1.5, 77

[56] References Cited

U.S. PATENT DOCUMENTS

| | | | |
|---|---|---|---|
| 1,744,594 | 1/1930 | Trzesniewski | 272/78 UX |
| 3,598,406 | 8/1971 | Robinson | 272/109 |
| 3,850,428 | 11/1974 | Zuber | 272/61 |
| 4,084,812 | 4/1978 | Melrose et al. | 272/78 |

OTHER PUBLICATIONS

"Black Belt", p. 57, 11-1970.

*Primary Examiner*—Richard C. Pinkham
*Assistant Examiner*—T. Brown
*Attorney, Agent, or Firm*—Warren D. Flackbert

[57] ABSTRACT

An athletic training arrangement, particularly suitable for martial arts, as karate, characterized as a unitary structure which affords selective physical conditioning in various activities at a single location and for one or more individuals simultaneously.

The presented arrangement is in the form of a movable framework collectively mounting, by way of example, training equipment representatively including a "stretch-a-ciser", a vertical striking pad, a speed bag and rebound ring, a horizontal power pad, a target pad, a holder for a heavy bag, and a board holder, all cooperatively arranged as a unit which requires no direct securing or attachment at a selected location.

1 Claim, 3 Drawing Figures

UNITARY SELF-CONTAINED PHYSICAL CONDITIONING STRUCTURE

The present application is a continuation of application Ser. No. 096,051, filed Nov. 20, 1979 and since abandoned.

The invention, therefore, serves to combine individual physical conditioning equipment for beneficial selective usage wherever desired.

As is known, rigorous training plays importance in proper conditioning for any given sporting activity. The preceding is particularly true in the instance of the physical demands required in connection with training for the martial arts, as in the increasing interest in karate. In view of the specialized physical requirements for the latter, involving a usage of a variety of apparatus, a need has arisen for a compact and/or centralized conditioning center which affords and provides the necessary training equipment at a single location, and for one or more participants.

The preceding need is augmented by the fact that heretofore the individual training equipment was necessarily, or at least mostly, spread throughout a gymnasium area, requiring specialized and oftentimes built-in mounting arrangements. In other words, chains or like supports were secured to the ceiling of the training area and/or the walls were marred by permanent type mount assemblies, requiring careful repair in the event particular conditioning apparatus was removed.

The invention overcomes any such disorganization in a gymnasium or like training area by providing a unitary structure, in the form of a movable framework, which mounts various forms of physical conditioning equipment independently of the space or area into which the framework or structure is placed. In other words, the particular conditioning mechanisms are arranged for use at a single location through structure which requires no permanent adaptation to an existing ceiling, walls, floors or the like. Thus, desired portability is afforded, in that any marring consequences, as to the aforesaid supporting surfaces, is avoided.

Moreover, and with respect to karate training, various conditioning equipment on the unitary mounting framework is within the ready reach of an individual, including, by way of example, a "stretch-a-ciser," i.e. an arrangement for strengthening leg muscles; a vertical striking pad; a speed bag and rebound ring; a horizontal power pad; a target pad; a holder for a heavy bag; and, a board holder, all being known in the sport. The invention, affords a self-supporting and/or a self-contained relationship between each of the preceding.

The framework of the invention is typically presented in a black or otherwise dark color to avoid visual distractions while perfecting training techniques, outlined or bordered, however, to avoid unnecessary bumping. The unitary conditioning structure further includes a self-contained floor to permit removable placement, where desired, without damage to existing floor areas, and, as well, cushioning for preventing the marring of the latter or any adjacent wall surfaces.

The invention is simple to erect, affords rigidity when assembled, and affords convenience features which will become more apparent from the following description, taken in conjunction with the accompanying drawings, wherein.

Figure 1:
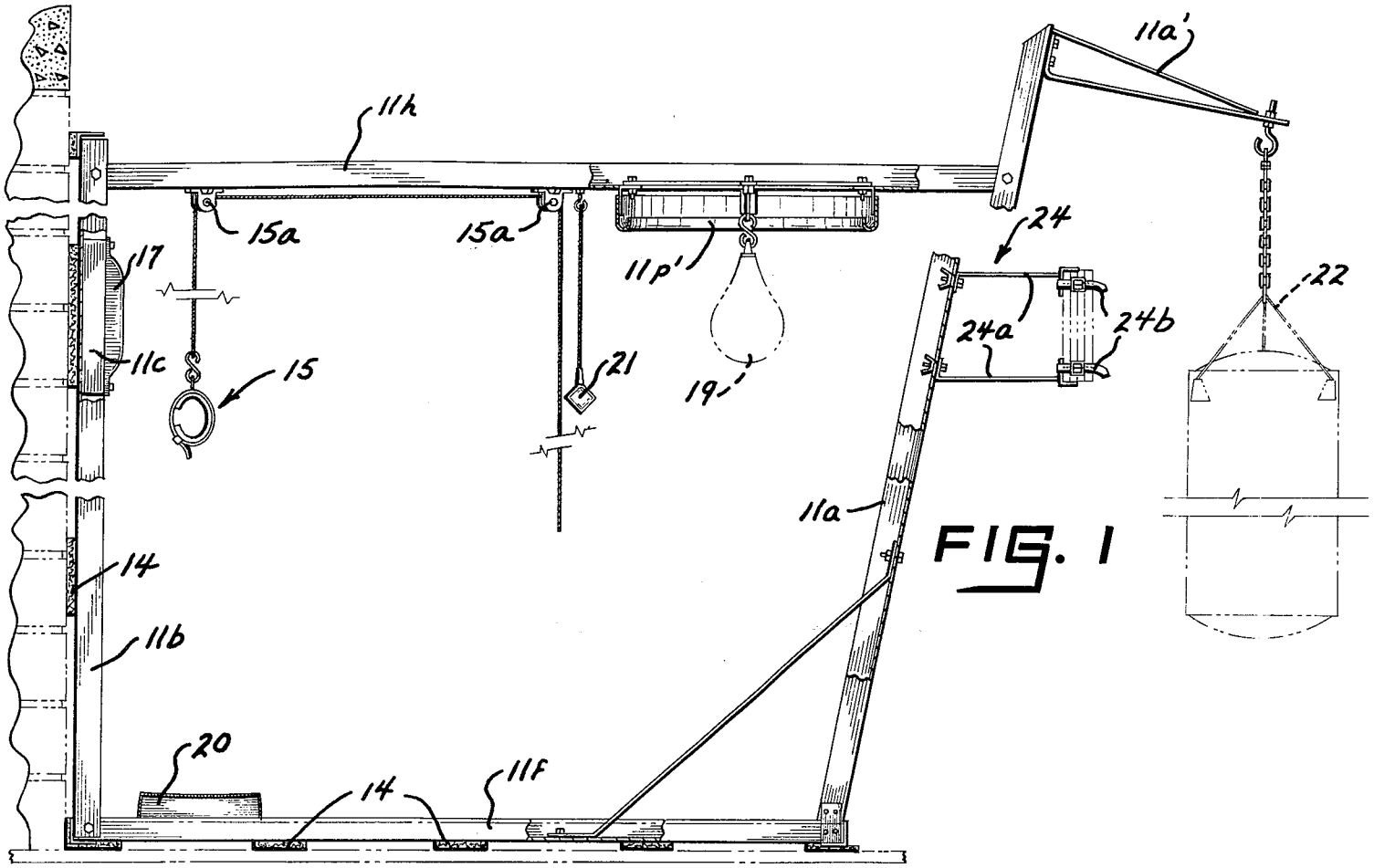
FIG. 1 is a view in side elevation showing a typical unitary conditioning structure in accordance with the teachings of the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, the invention is characterized by a unitary framework 11 defined by upstanding members 11*a*, 11*b* and 11*c*, where upstanding members 11*b* and 11*c* are interconnected by an upper lateral member 11*d* and a lower lateral member 11*e*. The upstanding member 11*a* is mounted at one end of base channel 11*f*, interconnecting a lateral member 11*g* and the lower lateral member 11*e*. The overall structure is presented in unitary form by reason of interconnecting members 11*h* and 11*m* which extend between the upstanding members 11*a*, 11*b* and 11*c*. As evident in FIG. 1, the upstanding member 11*a*, identifiable as a mast, angles outwardly, for reasons which will become apparent from the following discussion.

Figure 3:
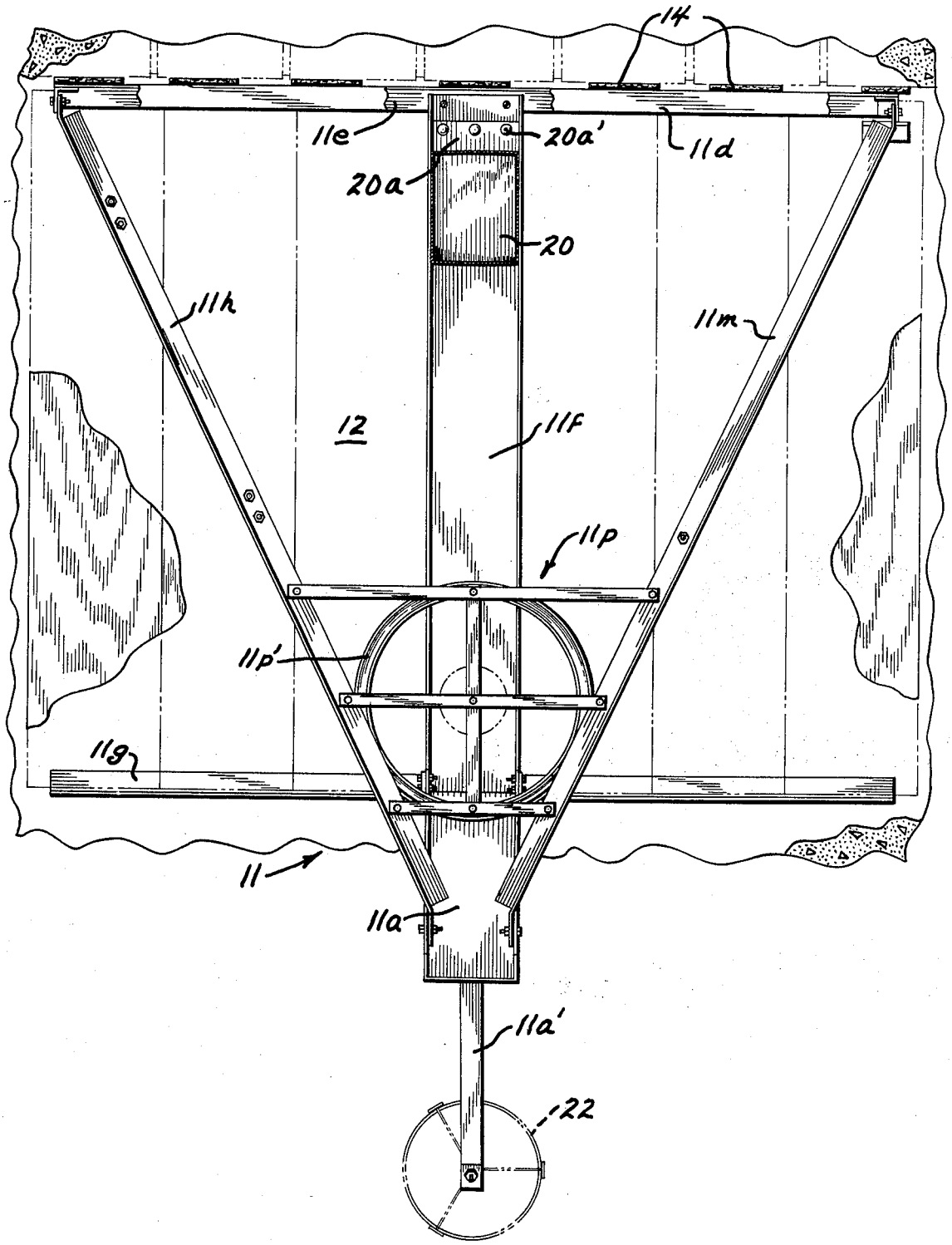
FIG. 3 is a top plan view of the structure of FIGS. 1 and 2.

The described structure further includes flooring 12, in the form of planks, seated between the lateral members 11*e* and 11*g* (see FIG. 3). In any event, with the preceding, a rigid assembled unit is afforded, in that the individual framework components may be bolted, spot-welded or otherwise secured together for achieving the desired compactness and self-contained relationship of the invention. The structure, when assembled, can be placed at any desired location, where cushioning or padding 14, typically in strip form, is provided to prevent any wall or floor damage after location and during use. The independent flooring 12 further serves the unitary function.

Importantly, the invention permits not only simultaneous conditioning necessary for successful athletic training, but being movable from one location to another, does not require permanent type affixing or securement at a predesired location. In other words, flexibility and mobility in use are paramount features.

In any event, and typically, at least five conditioning functions are afforded within the area of the aforedescribed structure, to wit, the provision of a "stretch-a-ciser" mechanism 15, i.e. a harness weight used around an individual's ankle which, with pulling action, serves leg muscle strengthening purposes. The "stretch-a-ciser" mechanism 15 is typically mounted on pulleys 15*a* secured to interconnecting member 11*h*.

Hand and elbow training, as well as focus practice, is afforded by a vertical striking pad 17 disposed on upstanding member 11*c*. The vertical striking pad 17 is typically filled with foam.

The interconnecting members 11*h* and 11*m* mount a subframework 11*p*, defined by a system of struts, for receiving a speed bag 19 (shown in phantom) disposed beneath a rebound ring 11*p'*, where the preceding provide eye and/or hand coordination and speed training.

A horizontal power pad 20, positioned on the base channel 11*f* (see FIGS. 1 and 3), serves to build hand and foot power, requiring higher impact force than the aforesaid vertical striking pad 17. Typically, the horizontal power pad 20 is filled with steel pellets and positioned by means of snaps 20*a'* along a hem 20*a* thereof secured to corresponding snaps positioned on the base channel 11*f*. Provision is also made for a target pad 21, suspended from interconnecting member 11*m*, typically in a diamond shape and secured to a steel cable.

Basically, the preceding strengthening and/or conditioning elements are known in the art, but the proximate location thereof in a self-contained arrangement presents a convenience and a correlation of use not present heretofore, as where each are commonly scattered and permanently secured throughout a training area.

The structure of the invention further includes a heavy bag holder 22 (shown in phantom), positioned on a chain hanging from an arm 11*a'* extending from the upper free end of the upstanding member 11*a* or mast, where the heavy bag serves to simulate opponent techniques, i.e. kick and punch practice. Importantly, the heavy bag does not require any connection with an existing ceiling in the training area.

Figure 2:
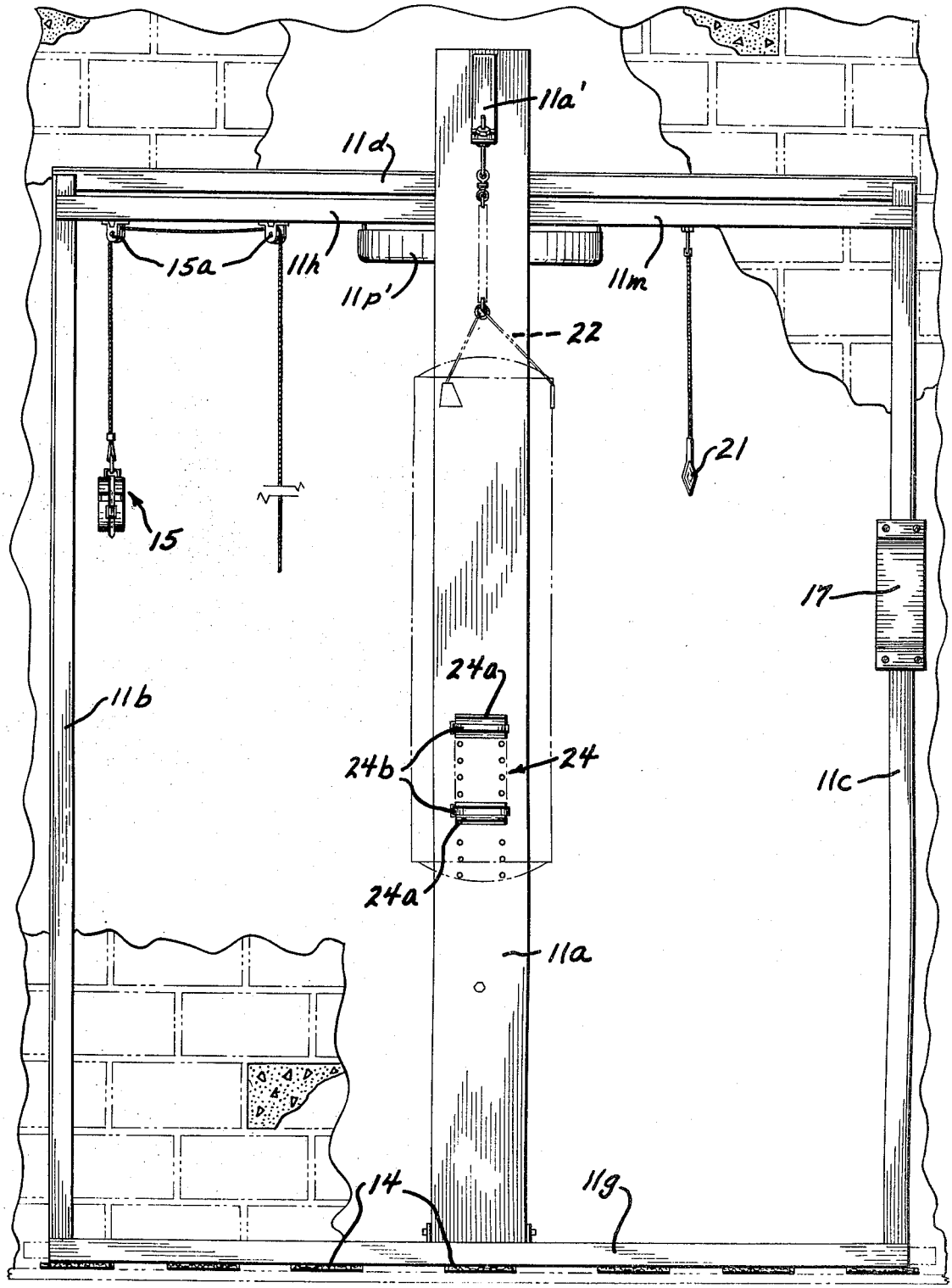
FIG. 2 is a view in front elevation of the structure of FIG. 1.

Another conditioning mechanism is a board holder 24, particularly evident in FIGS. 1 and 2. The board holder 24 is defined by outwardly extending flanged end members 24*a* adapted to receive elasticized straps 24*b* for retaining a series of boards (shown in phantom) in an original vertical position. In use, the aforesaid boards are caused to be broken by the individual during training/conditioning. In any event, provision is made for the vertical adjustment of the board holder 24 as, for example, through wing bolt-nut combinations in preselected openings in the upstanding member 11*a* (see FIG. 2).

In any event, the structure herein affords desired compactness, where, in a typical arrangement, and in approximate figures, the bottom channel 11*f* may be five feet in length, the interconnecting members 11*h* and 11*m* may each be slightly over six feet in length, the height may be seven feet or in excess thereof, and the lateral members 11*d*, 11*e* and 11*g* in the order of six feet. Importance, therefore, lies in the aforesaid dimensioning geometry of the training center.

From the preceding, it should be evident that the invention has satisfied a need in providing athletic conditioning structure in a unitary and self-contained form, being selectively placed wherever desired for use and obviating any necessity for direct attachment at the placement site. The structure affords versatility to one or more participants for simultaneous training with various conditioning mechanisms. Broadly, the invention combines what has heretofore been a series of independent training apparatus for presentation at a single location in a mutually cooperative relationship.

The athletic conditioning structure described hereabove is susceptible to various changes within the spirit of the invention including, by way of example, proportioning, the type of conditioning mechanisms employed, the mounting of each of such conditioning mechanisms, the overall assembled configuration, and the like. Thus, the preceding should be considered illustrative and not as limiting the scope of the following claims:

I claim:

1. An athletic conditioning apparatus for the martial arts comprising a framework independently movable from one location to another on a floor surface, said framework defined as a unitary assembly represented by interconnecting rear members in a quadrangular relationship abutting an impact receiving upstanding wall, interconnecting upper members formed in a converging configuration in plan view having an apex area remote from said rear members supporting a sub-framework receiving a rebound ring and speed bag, an interconnecting base member mounting an upwardly angling member connecting to said apex area and supporting an outwardly extending portion for a conditioning unit, and other conditioning units selectively locatable on said upwardly angling member, said upper members, said rear members and said base member, where another base member and a rear member support flooring, and where resilient cushioning members isolate said rear members of said framework from said upstanding wall and said base members of said framework from said floor surface.

* * * * *